US011382358B2

(12) United States Patent
Batista et al.

(10) Patent No.: US 11,382,358 B2
(45) Date of Patent: Jul. 12, 2022

(54) AEROSOL-GENERATING DEVICE WITH SUSCEPTOR LAYER

(71) Applicant: Philip Morris Products S.A., Neuchatel (CH)

(72) Inventors: Rui Nuno Batista, Morges (CH); Oleg Mironov, Cudrefin (CH); Ihar Nikolaevich Zinovik, Peseux (CH); Oleg Fursa, Gempenach (CH); Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 201 days.

(21) Appl. No.: 16/637,440

(22) PCT Filed: Jul. 25, 2018

(86) PCT No.: PCT/EP2018/070217
§ 371 (c)(1),
(2) Date: Feb. 7, 2020

(87) PCT Pub. No.: WO2019/030000
PCT Pub. Date: Feb. 14, 2019

(65) Prior Publication Data

US 2020/0245683 A1 Aug. 6, 2020

(30) Foreign Application Priority Data

Aug. 9, 2017 (EP) ..... 17185581

(51) Int. Cl.
*A24F 40/465* (2020.01)
*H05B 6/10* (2006.01)
*A24F 40/20* (2020.01)

(52) U.S. Cl.
CPC ..... *A24F 40/465* (2020.01); *H05B 6/108* (2013.01); *A24F 40/20* (2020.01)

(58) Field of Classification Search
CPC ..... A24F 47/00
(Continued)

(56) References Cited

U.S. PATENT DOCUMENTS 10,321,719 B2 * 6/2019 Peuchert ..... H05B 3/265
2014/0305449 A1 10/2014 Plojoux et al.
(Continued)

FOREIGN PATENT DOCUMENTS

EP 2 797 445 A1 11/2014
EP 2 921 066 A1 9/2015
(Continued)

OTHER PUBLICATIONS

Extended European Search Report dated Dec. 1, 2017, in Patent Application No. 17185581.0, 7 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided, including: a housing defining a chamber configured to receive at least a portion of an aerosol-generating article; an inductor coil disposed around at least a portion of the chamber; an elongate susceptor element projecting into the chamber; and a power supply and a controller connected to the inductor coil and configured to provide an alternating electric current to the inductor coil such that the inductor coil generates an alternating magnetic field to heat the elongate susceptor element and thereby heat at least a portion of an aerosol-generating article received in the chamber, the elongate susceptor element including an elongate support body and at least one heating portion formed from a susceptor layer on an outer surface of the elongate support body, and the elongate support body being formed from a thermally insu-
(Continued)

lative material and the susceptor layer including one or more susceptor materials.

14 Claims, 7 Drawing Sheets

(58) Field of Classification Search
USPC ..... 131/328–329
See application file for complete search history.

(56) References Cited

U.S. PATENT DOCUMENTS

| | | | | |
|---|---|---|---|---|
| 2017/0055580 | A1 | 3/2017 | Blandino et al. | |
| 2017/0086508 | A1 | 3/2017 | Mironov et al. | |
| 2018/0007971 | A1 | 1/2018 | Plojoux et al. | |
| 2018/0235278 | A1 | 8/2018 | Mahler et al. | |
| 2018/0289067 | A1* | 10/2018 | Courbat | H05B 6/108 |
| 2021/0145067 | A1* | 5/2021 | Bleloch | H05B 6/06 |

FOREIGN PATENT DOCUMENTS

| | | | |
|---|---|---|---|
| RU | 2014 131 464 | A | 2/2016 |
| WO | WO 95/27411 | A1 | 10/1995 |
| WO | WO 2013/098395 | A1 | 7/2013 |
| WO | WO 2014/048745 | A1 | 4/2014 |
| WO | WO 2015/131058 | A1 | 9/2015 |
| WO | WO 2015/175568 | A1 | 11/2015 |
| WO | WO 2015/176898 | A1 | 11/2015 |
| WO | WO 2015/177043 | A1 | 11/2015 |
| WO | WO 2015/177044 | A1 | 11/2015 |
| WO | WO 2015/177045 | A1 | 11/2015 |
| WO | WO 2015/177046 | A1 | 11/2015 |
| WO | WO 2015/177247 | A1 | 11/2015 |
| WO | WO 2015/177252 | A1 | 11/2015 |
| WO | WO 2015/177253 | A1 | 11/2015 |
| WO | WO 2015/177254 | A1 | 11/2015 |
| WO | WO 2015/177257 | A1 | 11/2015 |
| WO | WO 2015/177263 | A1 | 11/2015 |
| WO | WO 2015/177264 | A1 | 11/2015 |
| WO | WO 2015/177265 | A1 | 11/2015 |
| WO | WO 2015/177294 | A1 | 11/2015 |
| WO | WO 2015/198015 | A1 | 12/2015 |
| WO | WO 2016/075436 | A1 | 5/2016 |
| WO | WO 2016/090037 | A1 | 6/2016 |
| WO | WO 2016/156500 | A1 | 10/2016 |
| WO | WO 2016/184928 | A1 | 11/2016 |
| WO | WO 2016/184929 | A1 | 11/2016 |
| WO | WO 2016/184930 | A1 | 11/2016 |
| WO | WO 2017/001352 | A2 | 1/2017 |
| WO | WO 2017/001818 | A1 | 1/2017 |
| WO | WO 2017/001819 | A1 | 1/2017 |
| WO | WO 2017/001820 | A1 | 1/2017 |
| WO | WO 2017/005705 | A1 | 1/2017 |
| WO | WO 2017/029268 | A1 | 2/2017 |
| WO | WO 2017/029269 | A1 | 2/2017 |
| WO | WO 2017/029270 | A1 | 2/2017 |
| WO | WO 2017/036950 | A2 | 3/2017 |
| WO | WO 2017/036951 | A1 | 3/2017 |
| WO | WO 2017/036954 | A1 | 3/2017 |
| WO | WO 2017/036955 | A2 | 3/2017 |
| WO | WO 2017/036957 | A1 | 3/2017 |
| WO | WO 2017/036958 | A2 | 3/2017 |
| WO | WO 2017/036959 | A1 | 3/2017 |
| WO | WO 2017/064487 | A1 | 4/2017 |
| WO | WO 2017/068092 | A1 | 4/2017 |
| WO | WO 2017/068095 | A1 | 4/2017 |
| WO | WO 2017/068098 | A1 | 4/2017 |
| WO | WO 2017/068099 | A1 | 4/2017 |
| WO | WO 2017/068100 | A1 | 4/2017 |
| WO | WO 2017/072144 | A1 | 5/2017 |
| WO | WO 2017/072145 | A1 | 5/2017 |
| WO | WO 2017/072148 | A1 | 5/2017 |
| WO | WO 2017/072149 | A1 | 5/2017 |
| WO | WO 2017/077503 | A1 | 5/2017 |
| WO | WO 2017/085242 | A1 | 5/2017 |
| WO | WO 2017/207580 | A1 | 12/2017 |

OTHER PUBLICATIONS

International Preliminary Report on Patentability and Written Opinion dated Feb. 20, 2020, in PCT/EP2018/070217, 5 pages.
International Search Report and Written Opinion dated Sep. 28, 2018 in PCT/EP2018/070217 filed on Jul. 25, 2018.
Russian Federation Office Action dated Nov. 12, 2021 in Russian Federation Patent Application No. 2020109335/03(015231) (with English translation), 14 pages.

* cited by examiner

AEROSOL-GENERATING DEVICE WITH SUSCEPTOR LAYER

CROSS-REFERENCE TO RELATED APPLICATIONS

This application is a U.S. national stage application of PCT/EP2018/070217, filed on Jul. 25, 2018, which is based upon and claims the benefit of priority from European patent application no. 17185581.0, filed Aug. 9, 2017, the entire contents of each of which are incorporated herein by reference.

TECHNICAL FIELD

The present invention relates to an aerosol-generating device. In particular, the invention relates to an aerosol-generating device having an inductive heater for heating an aerosol-generating article using a susceptor. The present invention also relates to an aerosol-generating system comprising such an aerosol-generating device in combination with an aerosol-generating article for use with the aerosol-generating device.

DESCRIPTION OF THE RELATED ART

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the aerosol-generating article is received in the aerosol-generating device. In other aerosol-generating systems, an inductive heater is used rather than a resistive heating element. The inductive heater typically comprises an inductor forming part of the aerosol-generating device and a conductive susceptor element arranged such that it is in thermal proximity to the aerosol-forming substrate. During use, the inductor generates an alternating magnetic field to generate eddy currents and hysteresis losses in the susceptor element, causing the susceptor element to heat up, thereby heating the aerosol-forming substrate. The susceptor element is typically formed from a single piece of susceptor material, for example in the shape of a pin or blade. This may make it difficult to manufacture susceptor elements with different configurations.

It would be desirable to provide an aerosol-generating device which mitigates or overcomes these problems with known systems.

SUMMARY

According to a first aspect of the present invention, there is provided an aerosol-generating device comprising: a housing defining a chamber for receiving at least a portion of an aerosol-generating article; an inductor coil disposed around at least a portion of the chamber; an elongate susceptor element projecting into the chamber; and a power supply and a controller connected to the inductor coil and configured to provide an alternating electric current to the inductor coil such that, in use, the inductor coil generates an alternating magnetic field to heat the elongate susceptor element and thereby heat at least a portion of an aerosol-generating article received in the chamber. The elongate susceptor element comprises an elongate support body and at least one heating portion formed from a susceptor layer on an outer surface of the elongate support body. The elongate support body is formed from a thermally insulative material and the susceptor layer comprises one or more susceptor materials.

According to a second aspect of the present invention, there is provided an aerosol-generating system. The aerosol-generating system comprises an aerosol-generating device according to the first aspect of the present invention, in accordance with any of the embodiments discussed herein. The aerosol-generating system also comprises an aerosol-generating article having an aerosol-forming substrate and configured for use with the aerosol-generating device.

BRIEF DESCRIPTION OF THE DRAWINGS

The invention is further described, by way of example only, with reference to the accompanying drawings in which.

DETAILED DESCRIPTION

Figure 1:
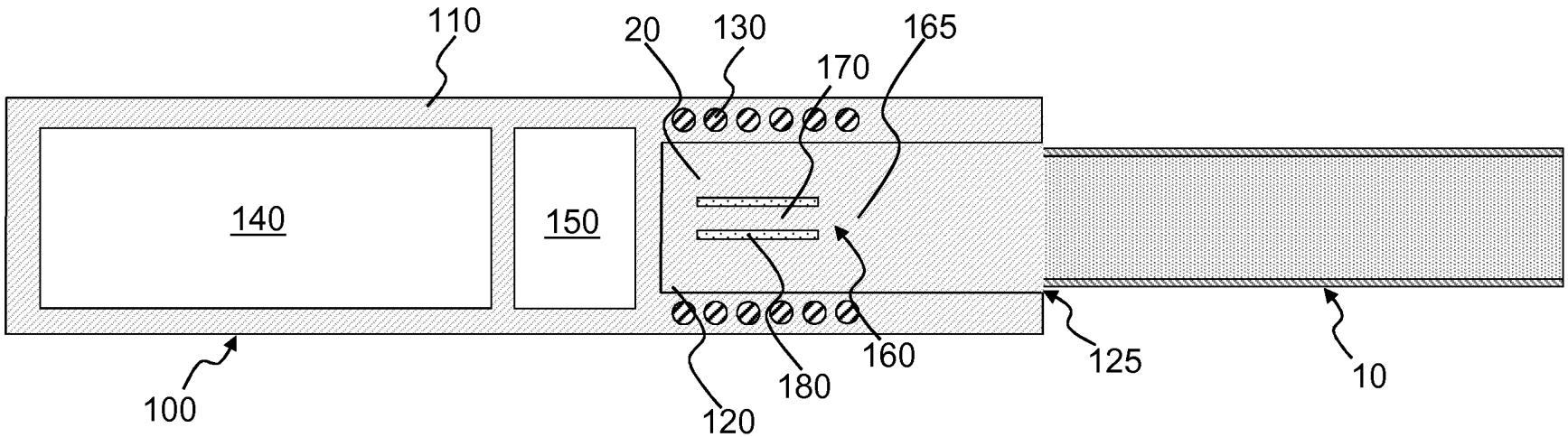
FIG. 1 is a schematic cross-sectional illustration of an aerosol-generating system comprising an aerosol-generating device in accordance with a first embodiment of the present invention and a first example of an aerosol-generating article.

As used herein, the term 'longitudinal' is used to describe the direction along the main axis of the aerosol-generating device, of the aerosol-generating article, or of a component of the aerosol-generating device or an aerosol-generating article, and the term 'transverse' is used to describe the direction perpendicular to the longitudinal direction. When referring to the chamber, the term 'longitudinal' refers to the direction in which an aerosol-generating article is inserted into the chamber and the term 'transverse' refers to a direction perpendicular to the direction in which an aerosol-generating article is inserted into the chamber.

Generally, the chamber will have an open end in which an aerosol-generating article is inserted, and a closed end opposite the open end. In such embodiments, the longitudinal direction is the direction extending between the open and closed ends. In certain embodiments, the longitudinal axis of the chamber is parallel with the longitudinal axis of the aerosol-generating device. For example, where the open end of the chamber is positioned at the proximal end of the aerosol-generating device. In other embodiments, the longitudinal axis of the chamber is at an angle to the longitudinal axis of the aerosol-generating device, for example transverse to the longitudinal axis of the aerosol-generating device. For example, where the open end of the chamber is positioned along one side of the aerosol-generating device such that an aerosol-generating article may be inserted into the chamber in direction which is perpendicular to the longitudinal axis of the aerosol-generating device.

As used herein, the term "proximal" refers to a user end, or mouth end of the aerosol-generating device, and the term "distal" refers to the end opposite to the proximal end. When referring to the chamber or the inductor coil, the term "proximal" refers to the region closest to the open end of the chamber and the term "distal" refers to the region closest to the closed end. The ends of the aerosol-generating device or the chamber may also be referred to in relation to the direction in which air flows through the aerosol-generating device. The proximal end may be referred to as the "downstream" end and the distal end referred to as the "upstream" end.

As used herein, the term "length" refers to the major dimension in a longitudinal direction of the aerosol-generating device, of an aerosol-generating article, or of a component of the aerosol-generating device, or of an aerosol-generating article.

As used herein, the term "width" refers to the major dimension in a transverse direction of the aerosol-generating device, of an aerosol-generating article, or of a component of the aerosol-generating device, or of an aerosol-generating article, at a particular location along its length. The term "thickness" refers to the dimension in a transverse direction perpendicular to the width.

As used herein, the term 'aerosol-forming substrate' relates to a substrate capable of releasing volatile compounds that can form an aerosol. Such volatile compounds may be released by heating the aerosol-forming substrate. An aerosol-forming substrate is part of an aerosol-generating article.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In the system, the aerosol-generating article and the aerosol-generating device cooperate to generate a respirable aerosol.

As used herein, the term 'elongate' refers to a component having a length which is greater than both its width and thickness, for example twice as great.

As used herein, a "susceptor element" means a conductive element that heats up when subjected to a changing magnetic field. This may be the result of eddy currents induced in the susceptor element, hysteresis losses, or both eddy currents and hysteresis losses. During use, the susceptor elements are located in thermal contact or close thermal proximity with the aerosol-forming substrate of an aerosol-generating article received in the chamber of the aerosol-generating device. In this manner, the aerosol-forming substrate is heated by the susceptor elements such that an aerosol is formed.

Advantageously, providing a susceptor element comprising an elongate support body and a heating portion formed from a susceptor layer on an outer surface of the elongate support body allows the size, position, or size and position of the heating portion to be easily varied by changing the size, position, or size and position of the susceptor layer. The size and configuration of the underlying support body may remain unchanged. This may provide a more flexible manufacturing process. Further, by providing a susceptor layer on an outer surface of the support body, the support body may be formed from a non-susceptor material which may be lighter or cheaper than a susceptor material. The elongate support body is formed from a thermally insulative material. This may allow heat generated in the susceptor layer to remain concentrated in the heating portion. It may reduce the amount of heat which is lost to other components of the aerosol-generating device. For example, it may reduce the extent to which the housing of the aerosol-generating device is heated up during use.

As used herein, the terms "thermally insulating" and "thermally insulative" refers to a material having a bulk thermal conductivity of less than about 50 milliwatts per metre Kelvin (mW/(mK)) at 23° C. and a relative humidity of 50% as measured using the modified transient plane source (MTPS) method.

Using inductive heating has the advantage that the heating element, in this case the susceptor element, need not be electrically joined to any other components, eliminating the need for solder or other bonding elements for the heating element. Furthermore, the inductor coil is provided as part of the aerosol-generating device, making it possible to construct an aerosol-generating article that is simple, inexpensive and robust. Aerosol-generating articles are typically disposable and produced in much larger numbers that the aerosol-generating devices with which they operate. Accordingly, reducing the cost of the aerosol-generating articles, even if it requires a more expensive device, can lead to significant cost savings for both manufacturers and consumers.

In addition, the use of inductive heating rather than a resistive coil may provide improved energy conversion because of power losses associated with a resistive coil, in particular losses due to contact resistance at connections between the resistive coil and the power supply.

Advantageously, using an inductor coil rather than a resistive coil may extend the lifetime of the aerosol-generating device since the inductor coil itself undergoes minimal heating during use of the aerosol-generating device. The susceptor layer may comprise a foil or film of susceptor material applied on the outer surface of the support body.

For example, a foil or film of susceptor material which is glued or welded to the outer surface of the support body.

The susceptor layer may be a susceptor coating deposited on the outer surface of the elongate support body. For example, the susceptor coating may be painted or printed onto the outer surface as a liquid. The susceptor coating may be deposited on the outer surface of the elongate support body by a vacuum deposition process, such as evaporation deposition, or sputtering. The susceptor coating may be deposited on the outer surface of the elongate support body by electrodeposition.

The susceptor layer may be formed from any material that can be inductively heated to a temperature sufficient to aerosolise an aerosol-forming substrate. Suitable materials for the susceptor layer include graphite, molybdenum, silicon carbide, stainless steels, niobium, aluminium, nickel, nickel containing compounds, titanium, and composites of metallic materials. Preferred susceptor layers comprise a metal or carbon. Advantageously the susceptor layer comprises or consists of a ferromagnetic material, for example, ferritic iron, a ferromagnetic alloy, such as ferromagnetic steel or stainless steel, ferromagnetic particles, and ferrite. A suitable susceptor layer may be, or comprise, aluminium. The susceptor layer preferably comprises more than 5 percent, preferably more than 20 percent, more preferably more than 50 percent or more than 90 percent of ferromagnetic or paramagnetic materials. Preferred elongate susceptor elements may be heated to a temperature in excess of 250 degrees Celsius.

The susceptor layer may comprise a metal or a metal alloy. The susceptor layer may be formed from a metal or a metal alloy.

The elongate support body may be formed from any suitable material.

The elongate support body may be formed from a non-ferromagnetic material. This means that the elongate support body is free of any susceptor material that is heatable by penetration with a varying magnetic field. Thus, when in use, more energy of a varying magnetic field is available to heat the susceptor layer. In other embodiments, the elongate support body may be formed from a ferromagnetic material.

The elongate susceptor element may have a thermally insulative tip. This may allow the susceptor element to be grasped at the tip by a user after use.

The thermally insulative tip may be formed from a thermally insulative cap or cover placed over the tip of the elongate support body. Advantageously, the elongate support body is formed from a thermally insulative material, and the thermally insulative tip is defined by a portion of the elongate support body which is free from any susceptor layer on its outer surface.

The at least one heating portion may extend over any suitable amount of the outer surface of the elongate support body. The at least one heating portion may extend only partially around the circumference of the elongate support body. The at least one heating portion may extend around the entire circumference of the elongate support body. The at least one heating portion may extend along only part of the length of the elongate support body. The at least one heating portion may extend along substantially the entire length of the elongate support body, for example at least 90 percent, or at least 95 percent of the entire length of the elongate support body.

The at least one heating portion may comprise a single heating portion.

The at least one heating portion may comprise a plurality of discrete heating portions each formed from a susceptor layer on the outer surface of the elongate support body.

The plurality of discrete heating portions may be positioned directly adjacent to each other. The plurality of discrete heating portions may be at different positions to each other along the length of the elongate support body. This may allow the heating portions to be used to heat different parts of an aerosol-generating article in thermal proximity to the susceptor element. For example, different parts of the same aerosol-forming substrate, or different aerosol-forming substrates, or an aerosol-forming substrate and an aerosol former of the aerosol-generating article.

The plurality of discrete heating portions may be spaced apart along the length of the elongate support body. This may allow the heating portions to be used to heat different parts of an aerosol-generating article in thermal proximity to the susceptor element without inadvertently heating adjacent parts of the aerosol-generating article. For example, heating spaced apart aerosol-forming substrates. For example heating a first aerosol-forming substrate with a first heating portion and heating a second aerosol-forming substrate with a second heating portion without heating the second aerosol-forming substrate with the first heating portion or heating the first aerosol-forming substrate with the second heating portion.

Where the at least one heating portion comprises a plurality of discrete heating portions, the heating portions may be formed from the same susceptor material or materials. For example, the plurality of discrete heating portions may comprise a first heating portion formed from a first susceptor layer and a second heating portion formed from a second susceptor layer, where both the first and second susceptor layers comprise the same susceptor material. This may allow for more consistent heating of the first and second heating portions. One or more of the heating portions may be formed from a susceptor layer comprising a susceptor material or materials which differs from the susceptor material or materials of the susceptor layer of at least one of the other heating portions. In other words, one or more of the heating portions may be formed from a susceptor layer having a different composition to the susceptor layer of at least one other heating portion, and thus different susceptor characteristics.

The plurality of discrete heating portions may comprise a first heating portion formed from a first susceptor layer comprising a first susceptor material and a second heating portion formed from a second susceptor layer comprising a second susceptor material which is different to the first susceptor material. With this arrangement, different heating profiles may be provided by the first and second heating portions by virtue of different susceptor characteristics of the first and second susceptor materials. The heat provided by each heating portion may be fine-tuned by selection of the susceptor material or materials forming part of each susceptor layer, or from which each susceptor layer is formed. This may also facilitate sequential heating of the susceptor element. For example, by forming the heating portions from susceptor materials for which optimal heating occurs at different frequencies of alternating current.

The first and second heating portions may have different temperature cycles. The portion of the elongate susceptor element between the first and second heating portions may comprise an electrically conductive material. In this manner, the electrically conductive material can resistively heat at least a portion of the aerosol-generating article when one or both of the heating portions is heated.

The susceptor element may be fixed to the housing of the aerosol-generating device. In such embodiments, the susceptor element may not be readily removed from the aerosol-generating device housing, for example without damaging the susceptor element or the housing.

Advantageously, the elongate susceptor element may be removably attached to the housing of the aerosol-generating device. For example, the elongate susceptor element may be removably attached to the housing within the chamber. The part of the aerosol-generating device that is heated and may therefore exhibit a shorter lifetime is the susceptor element. Thus, providing a removable elongate susceptor element allows the elongate susceptor element to be replaced easily and may extend the lifetime of the aerosol-generating device. Advantageously, providing a removable elongate susceptor element also facilitates cleaning of the susceptor element, replacement of the susceptor element, or both. It may also facilitate cleaning of the chamber. It may allow the susceptor element to be selectively replaced by a user according to the aerosol-generating article with which the susceptor element will be used. For example, certain susceptor elements may be particularly suited, or tuned, for use with a particular type of aerosol-generating article, or with an aerosol-generating article having a particular arrangement or type of aerosol-forming substrate. This may allow the performance of the aerosol-generating device with which the susceptor element is used to be optimised based on the type of aerosol-generating article.

The elongate susceptor element may be removably attached to the housing of the aerosol-generating device by any suitable mechanism. For example, by a threaded connection, by frictional engagement, or by a mechanical connection such as a bayonet, a clip, or equivalent, mechanism.

The elongate support body of the elongate susceptor element may comprise an aperture or recess at its base by which the elongate susceptor element is removably attached to the aerosol-generating device. In such embodiments, the aperture or recess may be configured to interact with a corresponding projection, pin, or stud whose position may be fixed in relation to the aerosol-generating device. For example, the elongate susceptor element may comprise a recess at its base which forms the female component of a connection between the susceptor element and the male component of the aerosol-generating device. The recess may be threaded. The elongate support element may comprise an aperture through its base which is configured to receive a locating pin. For example, a locating pin extending through a side wall of the aerosol-generating device housing to prevent movement of the susceptor element relative to the aerosol-generating device.

The elongate susceptor element may be attached to the housing directly or via one or more intermediate components. The elongate susceptor element may comprise a base portion configured for removable attachment to the aerosol-generating device. The elongate support body may extend orthogonally from the base portion. This may facilitate insertion of the susceptor element into the aerosol-generating device. The elongate susceptor element may be removably attached to the base portion, or fixed to the base portion.

The base portion may be configured to detachably connect to the aerosol-generating device housing by at least one of an interference fit, a bayonet connector, and a screw connector. The base portion of the elongate susceptor element may be configured for removable attachment to the housing by a magnetic attachment. Advantageously, a magnetic attachment provides a simple and effective mechanism for removably attaching the elongate susceptor element to the aerosol-generating device.

The base portion may comprise a permanent magnet and the aerosol-generating device may comprise a ferromagnetic material at an upstream end of the chamber. The base portion may comprise a ferromagnetic material and the aerosol-generating device may comprise a permanent magnet at an upstream end of the chamber. Advantageously, providing only one of the base portion and the aerosol-generating device with a permanent magnet may simplify and reduce the cost of manufacture of the aerosol-generating device.

The base portion may comprise a permanent magnet and the aerosol-generating device may comprise a permanent magnet at an upstream end of the chamber. Advantageously, providing both the base portion and the aerosol-generating device with a permanent magnet may increase the strength of the magnetic attachment when compared to embodiments comprising only a single permanent magnet. Advantageously, the permanent magnet in the base portion and the permanent magnet in the aerosol-generating device may each be oriented to that the attraction between the two permanent magnets results in a desired orientation of the elongate susceptor element when the elongate susceptor element is inserted into the chamber.

In embodiments in which the base portion is configured for removable attachment to the housing by a magnetic attachment, the aerosol-generating device may be combined with an extraction tool for removing the elongate susceptor element from the chamber. Preferably, the extraction tool is sized for insertion into the chamber and comprises a permanent magnet at an end of the extraction tool. The permanent magnet at the end of the extraction tool provides a stronger attractive force between the extraction tool and the base portion than the attractive force between the base portion and the aerosol-generating device. Preferably, the extraction tool comprises a cavity or cavities for receiving the elongate susceptor element when the extraction tool is inserted into the chamber.

Preferably, the housing comprises an opening at an end of the chamber for insertion of an aerosol-generating article into the chamber. Preferably, the base portion is sized and shaped for insertion of the elongate susceptor element into the chamber through the opening. Advantageously, this may eliminate the need for a separate aperture to facilitate insertion of the elongate susceptor elements into the chamber.

Preferably, a cross-sectional shape of the base portion is substantially the same as a cross-sectional shape of the chamber. The base portion may have a substantially circular cross-sectional shape.

The elongate susceptor element may be detachable from the base portion. Advantageously, this may facilitate re-use of the base portion with multiple elongate susceptor elements. This may be desirable, since the build-up of deposits may occur more quickly on the elongate susceptor element than the base portion.

Further optional and preferred features of the elongate susceptor element will now be described. In embodiments in which the elongate susceptor element comprises an elongate heating portion, the following optional and preferred features apply to the elongate heating portion.

The elongate susceptor element may have a protective external layer, for example a protective ceramic layer or protective glass layer. The protective external layer may encapsulate the elongate susceptor element. The elongate susceptor element may comprise a protective coating formed by a glass, a ceramic, or an inert metal, formed over a core of susceptor material.

The elongate susceptor element may have any suitable cross-section. For example, elongate susceptor elements according to the present invention may have a square, oval, rectangular, triangular, pentagonal, hexagonal, or similar cross-sectional shape. The elongate susceptor element may have a planar or flat cross-sectional area.

The elongate support body may be solid, hollow, or porous. The elongate susceptor element is preferably in the form of a pin, rod, blade, or plate. The elongate susceptor element preferably has a length of between 5 millimetres and 15 millimetres, for example between 6 millimetres and 12 mm millimetres or between 8 millimetres and 10 mm millimetres. The elongate susceptor element preferably has a width of between 1 millimetre and 8 millimetres, more preferably from about 3 millimetres to about 5 millimetres. The elongate susceptor element may have a thickness of from about 0.01 millimetres to about 2 millimetres. If the elongate susceptor element has a constant cross-section, for example a circular cross-section, it has a preferable width or diameter of between 1 millimetre and 5 millimetres.

The elongate susceptor element projects into the chamber. Preferably the elongate susceptor element has a free end projecting into the chamber. Preferably, the free end is configured for insertion into an aerosol-generating article when the aerosol-generating article is inserted in the chamber. Preferably, the free end of the elongate susceptor element is tapered. This means that the cross-sectional area of a portion of the elongate susceptor element decreases in a direction towards the free end. Advantageously, a tapered free end facilitates insertion of the elongate susceptor element into an aerosol-generating article. Advantageously, a tapered free end may reduce the amount of aerosol-forming substrate displaced by the elongate susceptor element during insertion of an aerosol-generating article into the chamber. This may reduce the amount of cleaning required. Preferably, the elongate susceptor element tapers towards a sharp tip at its free end.

The elongate support body may comprise an aperture or recess at its base by which the elongate susceptor element is removably attached to the aerosol-generating device. In such embodiments, the aerosol-generating device may further comprise a projection, pin, or stud with a shape corresponding to the shape of the aperture or recess. The position of the elongate susceptor element relative to the housing may be fixed by the removable receipt of the projection, pin, or stud in the aperture or recess in the elongate support body. For example, the elongate susceptor element may comprise a recess at its base and the housing may comprise a corresponding protrusion. The housing may comprise a recess in a wall of the chamber and the elongate susceptor element may comprise a corresponding protrusion. In such embodiments, the recess and protrusion form the female and male counterparts, respectively, of a connection mechanism between the elongate susceptor element and the housing. The recess may be threaded. The elongate support element may comprise an aperture through at its base and the aerosol-generating device may further comprise a locating pin removably received in the aperture. The aerosol-generating device may comprise an aperture positioned on a side of the housing, wherein the locating pin extends through the aperture of the housing and into the aperture of the elongate support body to prevent movement of the elongate susceptor element relative to the housing.

The elongate susceptor element may be removably attached to the housing of the aerosol-generating device directly or via one or more intermediate components.

In any of the embodiments described herein, preferably at least a portion of the elongate susceptor element extends in the longitudinal direction of the chamber. That is, preferably at least a portion of the elongate susceptor element extends substantially parallel with the longitudinal axis of the chamber. As used, herein, the term "substantially parallel" means within plus or minus 10 degrees, preferably within plus or minus 5 degrees. Advantageously, this facilitates insertion of at least a portion of the elongate susceptor element into an aerosol-generating article when the aerosol-generating article is inserted into the chamber.

The magnetic axis of the inductor coil may be at an angle to, that is, non-parallel with, the longitudinal axis of the chamber. In preferred embodiments, the magnetic axis of the inductor coil is substantially parallel with the longitudinal axis of the chamber. This may facilitate a more compact arrangement. Preferably, at least a portion of the elongate susceptor element is substantially parallel with the magnetic axis of the inductor coil. The may facilitate even heating of the elongate susceptor element by the inductor coil. In particularly preferred embodiments, the elongate susceptor element is substantially parallel with the magnetic axis of the inductor coil and with the longitudinal axis of the chamber.

The elongate susceptor element may be at least partially coincident with the longitudinal axis of the chamber. For example, the elongate susceptor element may be at an angle to the longitudinal axis of the chamber and may pass through the longitudinal axis of the chamber at a position along its length. The elongate susceptor element may be parallel with the longitudinal axis of the chamber and positioned centrally within the chamber such that it extends along the longitudinal axis of the chamber.

The elongate susceptor element may extend along only part of the length of the chamber. The elongate susceptor element may extend along substantially the entire length of the chamber. Advantageously, the elongate susceptor element extends beyond the chamber to protrude from the housing. Where the elongate susceptor element is removable, providing an elongate susceptor element which extends beyond the chamber to protrude from the housing may facilitate grasping by a user for removal of the susceptor element. Advantageously, the elongate susceptor element protrudes from the housing, is removably attached to the housing and has a thermally insulative tip.

Preferably, the aerosol-generating device is portable. The aerosol-generating device may have a size comparable to a conventional cigar or cigarette. The aerosol-generating device may have a total length between approximately 30 millimetres and approximately 150 millimetres. The aerosol-generating device may have an external diameter between approximately 5 millimetres and approximately 30 millimetres.

The housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the aerosol-generating device, for example a button to initiate heating of the aerosol-generating device or display to indicate a state of the aerosol-generating device or of the aerosol-forming substrate.

The aerosol-generating device comprises a power supply. The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the aerosol-generating device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be a DC power supply. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The power supply may be configured to operate at high frequency. As used herein, the term "high frequency oscillating current" means an oscillating current having a frequency of between 500 kilohertz and 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The aerosol-generating device comprises a controller connected to the inductor coil and the power supply. The controller is configured to control the supply of power to the inductor from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the inductor coil. Current may be supplied to the inductor coil continuously following activation of the aerosol-generating device or may be supplied intermittently, such as on a puff by puff basis. The electric circuitry may advantageously comprise DC/AC inverter, which may comprise a Class-D or Class-E power amplifier.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the chamber of the aerosol-generating device may be arranged such that the aerosol-generating article is partially received within the chamber of the aerosol-generating device. The chamber of the aerosol-generating device and the aerosol-generating article may be arranged such that the aerosol-generating article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may comprise two spaced apart aerosol-forming segments. The portion of the aerosol-generating article between the two aerosol-forming segments may be a flavor portion. This may be a porous material impregnated with flavours or aerosol enhancing substances (e.g. menthol or other herbal particles) that can be aerosolized at low temperatures. The flavours or aerosol enhancing substances may take the form of liquid or gels.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 mm. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Features described in relation to one or more aspects may equally be applied to other aspects of the invention. In particular, features described in relation to the elongate susceptor element of the first aspect may be equally applied to the aerosol-generating device of the second aspect, and to the system of the third aspect, and vice versa.

Figure 2:
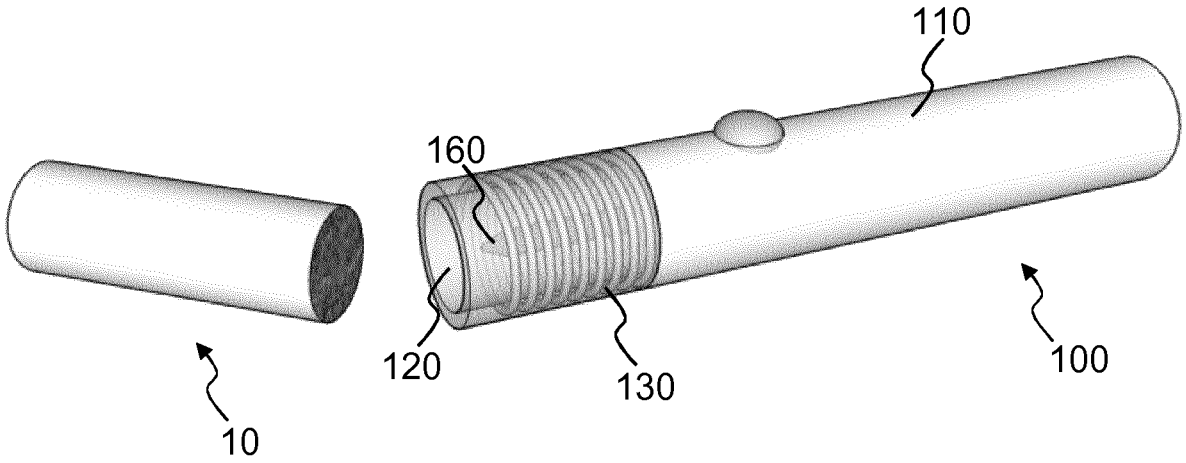
FIG. 2 is a perspective side view of the aerosol-generating system of FIG. 1, in which the inductor coil and the elongate susceptor element are also shown.
Figure 3:
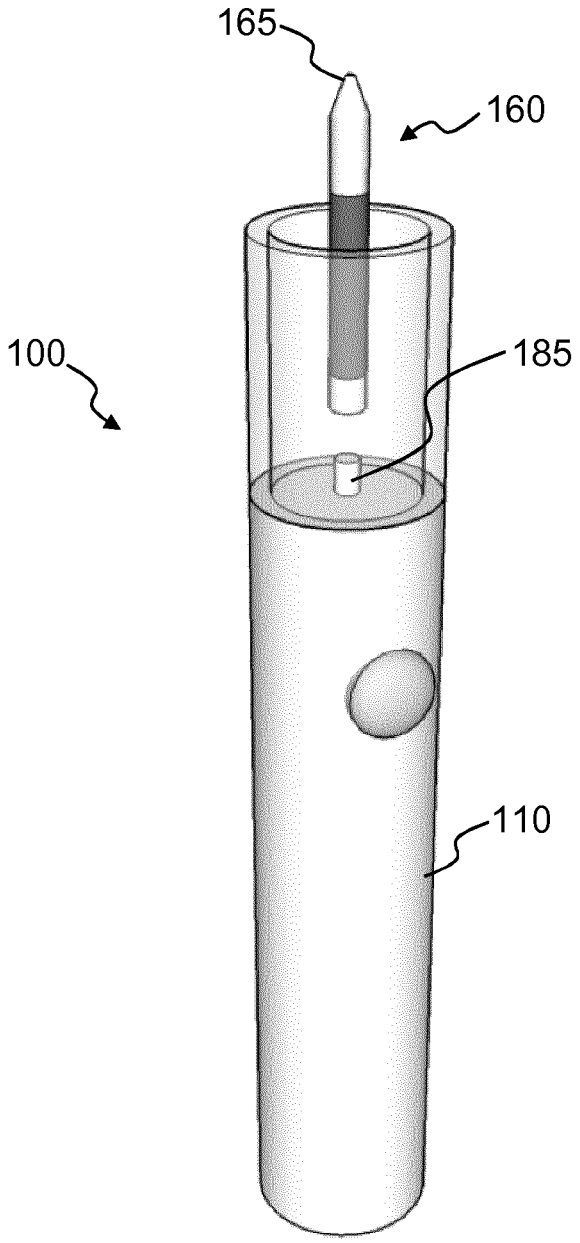
FIG. 3 is a partially-exploded perspective view of the aerosol-generating device of FIG. 1 in which the interior of the chamber is also shown.
Figure 4:
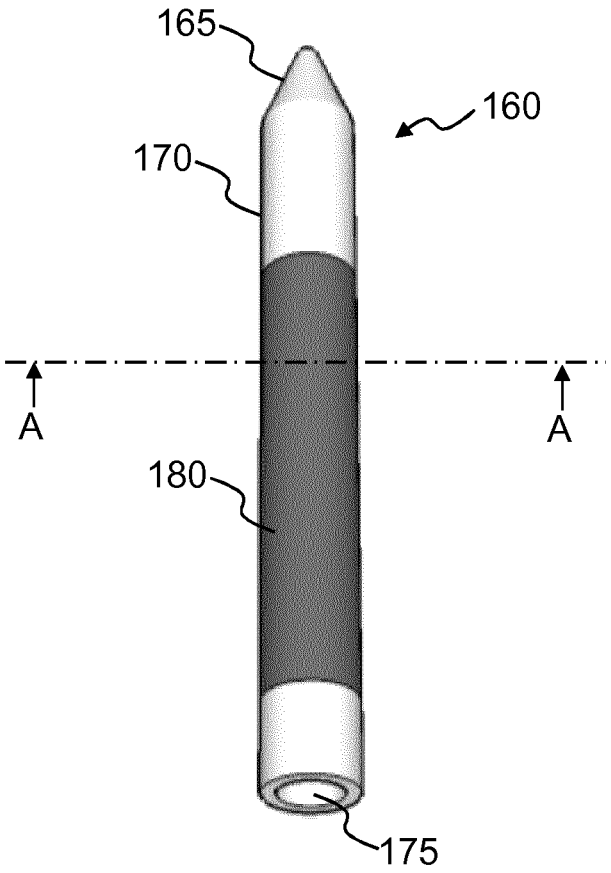
FIG. 4 is a perspective end view of the elongate susceptor element of the aerosol-generating system of FIG. 1.
Figure 5:
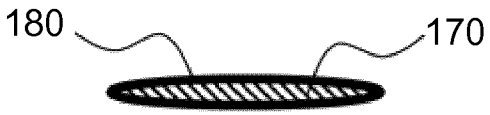
FIG. 5 is a schematic cross-sectional view taken through line A-A in FIG. 4.

FIG. 1 and FIG. 2 show an aerosol-generating system according to a first embodiment of the invention. The aerosol-generating system comprises an aerosol-generating device 100 according to a first embodiment and an aerosol-generating article 10 configured for use with the aerosol-generating device 100. FIGS. 3, 4 and 5 show different views of the aerosol-generating device 100.

The aerosol-forming article 10 includes an aerosol-forming segment 20 at its distal end. The aerosol-forming segment 20 contains an aerosol-forming substrate, for example a plug comprising tobacco material and an aerosol former, which is heatable to generate an aerosol.

The aerosol generating device 100 comprises a device housing 110 defining a chamber 120 for receiving the aerosol-generating article 10. The proximal end of the housing 110 has an insertion opening 125 through which the aerosol-generating article 10 may be inserted into and removed from the chamber 120. An inductor coil 130 is arranged inside the aerosol-generating device 100 between an outer wall of the housing 110 and the chamber 120. The inductor coil 130 is a helical inductor coil having a magnetic axis corresponding to the longitudinal axis of the chamber 120, which, in this embodiment, corresponds to the longitudinal axis of the aerosol-generating device 100. As shown in FIG. 1, the inductor coil 130 is located adjacent to a distal portion of the chamber 120 and, in this embodiment, extends along only part of the length of the chamber 120. In other embodiments, the inductor coil 130 may extend along all, or substantially all, of the length of the chamber 120, or may extend along only part of the length of the chamber 120 and be located away from the distal portion of the chamber 120. For example, the inductor coil 130 may extend along only part of the length of the chamber 120 and be adjacent to a proximal portion of the chamber 120. The inductor coil 130 is formed from a wire and has a plurality of turns, or windings, extending along its length. The wire may have any suitable cross-sectional shape, such as square, oval, or triangular. In this embodiment, the wire has a circular cross-section. In other embodiments, the wire may have a flat cross-sectional shape. For example, the inductor coil may be formed from a wire having a rectangular cross-sectional shape and wound such that the maximum width of the cross-section of the wire extends parallel to the magnetic axis of the inductor coil. Such flat inductor coils may allow the outer diameter of the inductor, and therefore the outer diameter of the device, to be minimized.

The aerosol generating device 100 also includes an internal electric power supply 140, for example a rechargeable battery, and a controller 150, for example a printed circuit board with circuitry, both located in a distal region of the housing 110. The controller 150 and the inductor coil 130 both receive power from the power supply 140 via electrical connections (not shown) extending through the housing 110. Preferably, the chamber 120 is isolated from the inductor coil 130 and the distal region of the housing 110, which contains the power source 140 and the controller 150, by a fluid-tight separation. Thus, electric components within the aerosol generating device 100 may be kept separate from aerosol or residues produced within the chamber 120 by the aerosol generating process. This may also facilitate cleaning of the aerosol generating device 100, since the chamber 120 may be made completely empty simply by removing the aerosol-generating article. This arrangement may also reduce the risk of damage to the aerosol generating device, either during insertion of an aerosol-generating article or during cleaning, since no potentially fragile elements are exposed within the chamber 120. Ventilation holes (not shown) may be provided in the walls of the housing 110 to allow airflow into the chamber 120. Alternatively, or in addition, airflow may enter the chamber 120 at the opening 125 and flow along the length of the chamber 120 between the outer walls of the aerosol-generating article 10 and the inner walls of the chamber 120.

The aerosol generating device 100 also includes an elongate susceptor element 160 projecting into the chamber 120. The elongate susceptor element 160 is parallel with the longitudinal axis of the chamber 120 and with the magnetic axis of the inductor coil 130. The elongate susceptor element 160 comprises an elongate support body 170 and a susceptor layer 180 applied on an outer surface of the elongate support body 170. The susceptor layer 180 comprises a susceptor material and defines a heating portion of the elongate susceptor element. The elongate susceptor element 160 is tapered towards its free end to form a sharp tip. This makes it easier to insert the elongate susceptor element 160 into the aerosol-forming substrate of an aerosol-generating article received in the cavity. In this embodiment, the elongate support body 170 is formed from a thermally insulative material and no susceptor layer is applied at the free end of the elongate support body 170. In this manner, the elongate support body 170 defines a thermally insulative tip 165 at the free end of the elongate susceptor element 160.

When the aerosol generating device 100 is actuated, a high-frequency alternating current is passed through the inductor coil 130 to generate an alternating magnetic field within the distal portion of the chamber 120 of the aerosol generating device 100. The magnetic field preferably fluctuates with a frequency of between 1 and 30 megahertz, preferably between 2 megahertz and 10 megahertz, for example between 5 megahertz and 7 megahertz. When an aerosol-generating article 10 is correctly located in the chamber 120, the heating portion 180 formed by the susceptor layer is located within the aerosol-forming substrate 20 of the aerosol-generating article. The fluctuating field generates eddy currents within the susceptor layer 180, which is heated as a result. Further heating is provided by magnetic hysteresis losses within the susceptor layer 180. The heated susceptor element 160 heats the aerosol-forming substrate 20 of the aerosol-generating article 10 to a sufficient temperature to form an aerosol. The aerosol may then be drawn downstream through the aerosol-generating article 10 for inhalation by the user. Such actuation may be manually operated or may occur automatically in response to a user drawing on the aerosol-generating article 10, for example by using a puff sensor.

FIGS. 3 to 5 show the elongate susceptor element 160 of the first embodiment in more detail. As shown, the elongate support body 170 comprises a recess 175 in its base and the aerosol-generating device comprises a projection 185 at the upstream end of the chamber 120. The shape and dimensions of the recess 175 correspond to the shape and dimensions of the projection 185. In this embodiment, the recess 175 and the projection 185 are circular and cylindrical. However, other shapes may be envisaged. Longitudinal and transverse movement of the elongate susceptor element 160 relative to the housing 110 is substantially prevented by the removable receipt of the projection 185 into the recess 175. The projection 185 and the recess 175 thus form male and female counterparts of a removable connection means between the housing 110 and the elongate susceptor element 160. In this embodiment, the projection is held in the recess by frictional engagement. In other embodiments, the projection and recess may be threaded. In other embodiments, the projection may be provided on the elongate support body 170 and the recess provided in the housing. As best seen in FIG. 5, the susceptor layer 180 extends around the entire circumference of the elongate support body 170.

Figure 6:
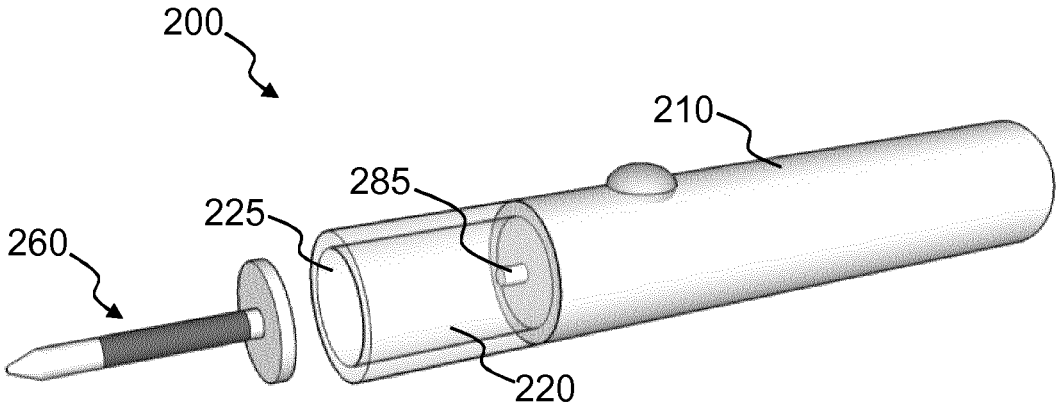
FIG. 6 is a partially-exploded perspective side view of an aerosol-generating device in accordance with a second embodiment of the present invention, in which the interior of the chamber is also shown.
Figure 7:
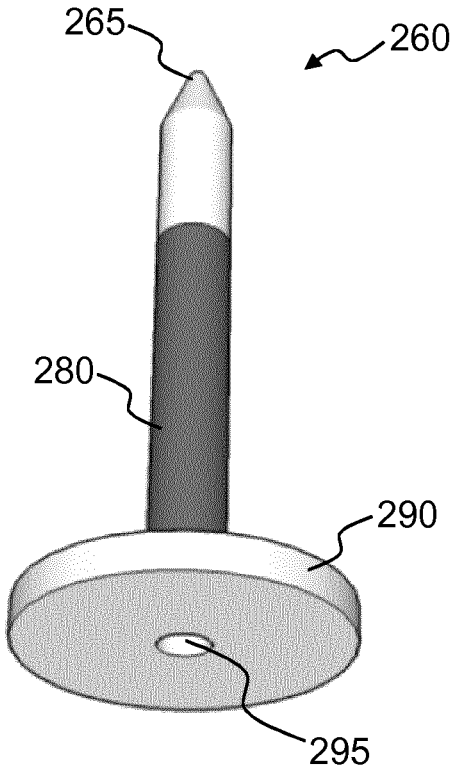
FIG. 7 is a perspective end view of the elongate susceptor element of the aerosol-generating device of FIG. 6.

FIGS. 6 and 7 illustrate an aerosol-generating device 200 according to a second embodiment. The aerosol-generating device 200 of the second embodiment is similar in construction and operation to the aerosol-generating device 100 of the first embodiment and where the same features are present, like reference numerals have been used. However, unlike the aerosol-generating device 100 of the first embodiment, the elongate susceptor element 260 of the aerosol-generating device 200 further comprises a base portion 290 by which the elongate susceptor element 260 is removably attached to the housing 210. The elongate support body 270 is attached to the base portion 290 and extends orthogonally from the base portion 290. This may facilitate insertion of the elongate susceptor element 260 into the aerosol-generating device 200. The base portion 290 of the elongate susceptor element 270 is sized and shaped for insertion into the chamber 220 through the opening 225. This eliminates the need for a separate aperture for insertion of the elongate susceptor element 260 into the chamber 220. The cross-sectional shape of the base portion 290 is substantially the same as a cross-sectional shape of the chamber 220. In this embodiment, the base portion 290 and the chamber 220 both have substantially circular cross-sectional shapes.

As with the aerosol-generating device 100 of the first embodiment, the aerosol-generating device 200 comprises a projection 285 at the upstream end of the chamber 220. The base portion 290 comprises a recess 295 in its base. The shape and dimensions of the recess 295 correspond to the shape and dimensions of the projection 285. As with the aerosol-generating device 100 of the first embodiment, the recess 295 and the projection 285 are circular and cylindrical, although other shapes may be envisaged. The projection 285 and the recess 295 form male and female counterparts of a removable connection means between the housing 210 and the elongate susceptor element 260. The projection 285 is held in the recess 295 by frictional engagement. In other embodiments, the projection and recess may be threaded. In other embodiments, the projection may be provided on the elongate support body and the recess provided in the housing.

Figure 8:
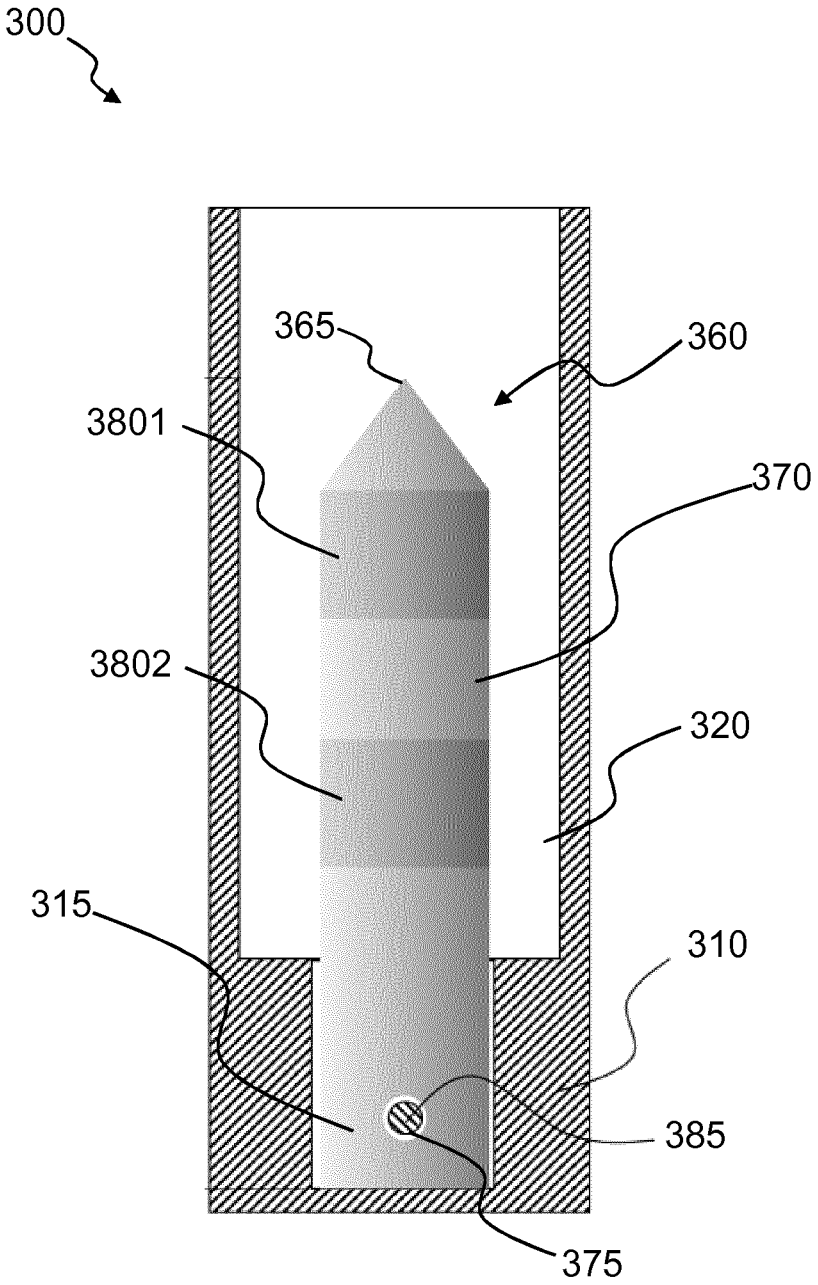
FIG. 8 is partial cross-sectional illustration of an aerosol-generating device in accordance with a third embodiment of the present invention.
Figure 9:
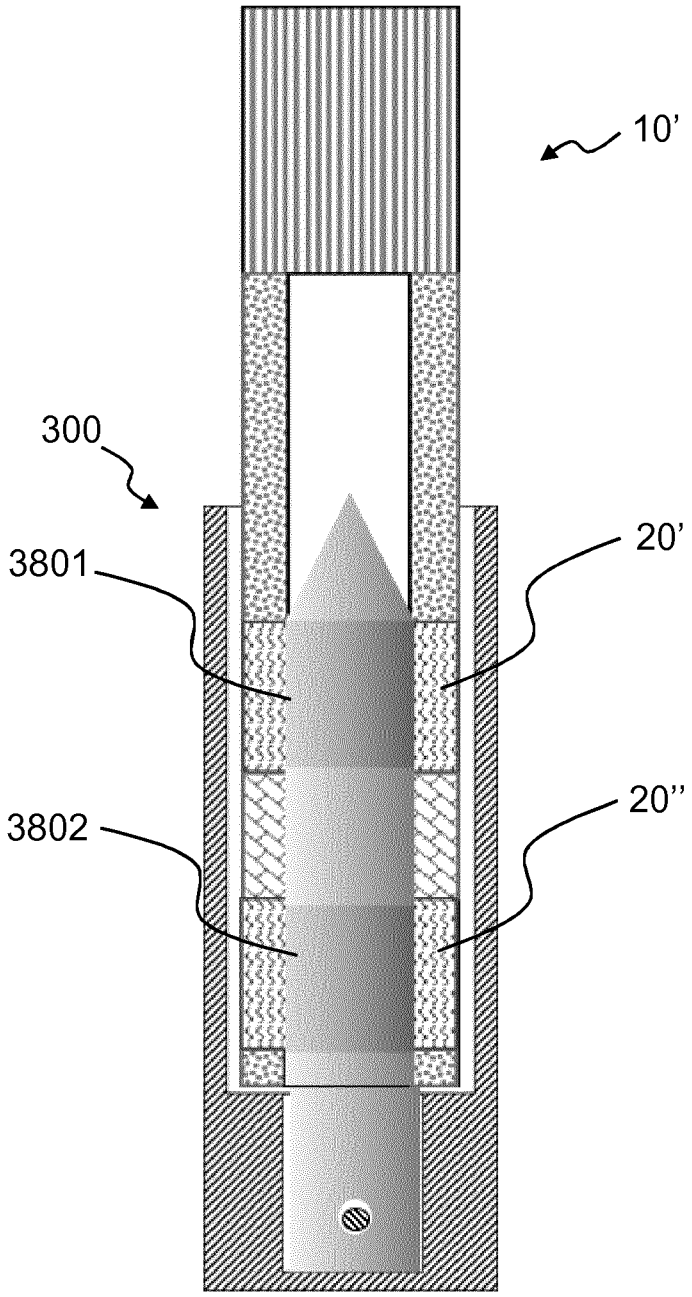
FIG. 9 is partial cross-sectional illustration of an aerosol-generating system comprising the aerosol-generating device of FIG. 8 and a second example of an aerosol-generating article.

FIGS. 8 and 9 illustrate the downstream end of an aerosol-generating device 300 according to a third embodiment. The aerosol-generating device 300 of the third embodiment is similar in construction and operation to the aerosol-generating device 100 of the first embodiment and where the same features are present, like reference numerals have been used. The housing 310 of the aerosol-generating device 300 includes a cavity 315 in the base of the chamber 320 into which the distal end of the elongate support body 370 is received. The cavity 315 has the same or similar shape to the base of the elongate support body 370 so that relative movement between the housing 310 and the elongate susceptor element 360 in the transverse plane is substantially prevented by the cavity 315. The elongate support body 370 includes an aperture 375 towards its distal end. The housing 310 includes a pin aperture (not shown) in one of its sides in the region of the aperture 375. The aerosol-generating device 300 includes a locating pin 385 inserted through the pin aperture and into the aperture 375 of the elongate support element. The pin 385 is held in the aperture 375 by frictional engagement. Relative movement between the housing 310 and the elongate susceptor element 360 in the longitudinal direction is substantially prevented by the locating pin 385.

Unlike the aerosol-generating devices 100 and 200 of the first and second embodiments, the elongate susceptor element 360 of the third embodiment of aerosol-generating device 300, has first and second discrete heating portions 3801 and 3802. The heating portions 3801, 3802 are each formed from a susceptor layer applied on the outer surface of the elongate support body 370. The two discrete heating portions 3801, 3802 are spaced apart along the length of the elongate support body 370. This facilitates heating of an aerosol-generating article 10' having two spaced apart aerosol-forming segments 20' and 20", as shown in FIG. 9. In this manner, the first aerosol-forming segment 20' may be heated by the first heating portion 3801 and the second aerosol-forming segment 20" may be heated by the second heating portion 3802. In this embodiment, the first and second heating portions 3801, 3802 are formed from the same susceptor material. However, in other embodiments, the composition or dimensions of the susceptor layers from which the first and second heating portions 3801, 3802 are formed may differ. Advantageously, this may facilitate fine-tuning of the heating characteristics of the elongate susceptor element 360 by selecting different susceptor characteristics for the first and second heating portions 3801, 3802. The portion of the aerosol-generating article between the two aerosol-forming segments may be a flavor portion. This may be a porous material impregnated with flavours or aerosol enhancing substances (e.g. menthol or other herbal particles) that can be aerosolized at low temperatures. The flavours or aerosol enhancing substances may take the form of liquid or gels. The first and second heating portions may be powered separately. The first and second heating portions may have different temperature cycles. The portion of the elongate susceptor element between the first and second heating portions may comprise an electrically conductive material. In this manner, the electrically conductive material can resistively heat the flavor portion when one or both of the heating portions is heated.

The exemplary embodiments described above are not intended to limit the scope of the claims. Other embodiments consistent with the exemplary embodiments described above will be apparent to those skilled in the art.

The invention claimed is:

1. An aerosol-generating device, comprising:

a housing defining a chamber configured to receive at least a portion of an aerosol-generating article;

an inductor coil disposed around at least a portion of the chamber;

an elongate susceptor element projecting into the chamber; and a power supply and a controller connected to the inductor coil and configured to provide an alternating electric current to the inductor coil such that the inductor coil generates an alternating magnetic field to heat the elongate susceptor element and thereby heat at least a portion of an aerosol-generating article received in the chamber, wherein the elongate susceptor element comprises an elongate support body and at least one heating portion formed from a susceptor layer on an outer surface of the elongate support body, and wherein the elongate support body is formed from a thermally insulative material and the susceptor layer comprises one or more susceptor materials.

2. The aerosol-generating device according to claim 1, wherein the susceptor layer is a susceptor coating deposited on the outer surface of the elongate support body.

3. The aerosol-generating device according to claim 1, wherein the susceptor layer is formed from a metal or a metal alloy.

4. The aerosol-generating device according to claim 1, wherein the elongate support body is formed from a non-ferromagnetic material.

5. The aerosol-generating device according to claim 1, further comprising a thermally insulative tip.

6. The aerosol-generating device according to claim 5, wherein the thermally insulative tip is defined by a portion of the elongate support body which is free from any susceptor layer on an outer surface thereof.

7. The aerosol-generating device according to claim 1, wherein the at least one heating portion comprises a plurality of discrete heating portions each formed from a susceptor layer on the outer surface of the elongate support body.

8. The aerosol-generating device according to claim 7, wherein the plurality of discrete heating portions are spaced apart along a length of the elongate support body.

9. The aerosol-generating device according to claim 7, wherein the plurality of discrete heating portions comprises a first heating portion formed from a first susceptor layer comprising a first susceptor material and a second heating portion formed from a second susceptor layer comprising a second susceptor material, which is different than the first susceptor material.

10. The aerosol-generating device according to claim 1, wherein the elongate susceptor element is removably attached to the housing within the chamber.

11. The aerosol-generating device according to claim 10, wherein the elongate support body comprises an aperture or recess at a base thereof by which the elongate susceptor element is removably attached to the housing.

12. The aerosol-generating device according to claim 10, wherein the elongate susceptor element comprises a base portion configured for removable attachment to the housing, and wherein the elongate support body extends orthogonally from the base portion.

13. The aerosol-generating device according to claim 1, wherein the elongate susceptor element extends beyond the chamber to protrude from the housing.

14. An aerosol-generating system, comprising:

an aerosol-generating device according to claim 1; and an aerosol-generating article having an aerosol-forming substrate configured for the aerosol-generating device.

* * * * *